US009242250B2

(12) United States Patent
El-Fahmawi

(10) Patent No.: US 9,242,250 B2
(45) Date of Patent: Jan. 26, 2016

(54) MAGNETIC SEPARATION DEVICE AND METHODS

(75) Inventor: Bassam El-Fahmawi, Fremont, CA (US)

(73) Assignee: Corning Incorporated, Corning, NY (US)

( * ) Notice: Subject to any disclaimer, the term of this patent is extended or adjusted under 35 U.S.C. 154(b) by 714 days.

(21) Appl. No.: 13/554,565

(22) Filed: Jul. 20, 2012

(65) Prior Publication Data

US 2013/0026104 A1 Jan. 31, 2013

Related U.S. Application Data

(60) Provisional application No. 61/513,265, filed on Jul. 29, 2011.

(51) Int. Cl.

| | |
|---|---|
| ***B03C 1/28*** | (2006.01) |
| ***B03C 1/01*** | (2006.01) |
| ***B01L 9/06*** | (2006.01) |

(52) U.S. Cl.

CPC . *B03C 1/284* (2013.01); *B01L 9/06* (2013.01); *B03C 1/01* (2013.01); *B03C 1/288* (2013.01); *B01L 2200/025* (2013.01); *B01L 2400/043* (2013.01); *B03C 2201/18* (2013.01); *B03C 2201/26* (2013.01)

(58) Field of Classification Search

CPC ..... B03C 1/284; B03C 1/01; B03C 2201/18; B01L 9/06; B01L 2200/025

See application file for complete search history.

(56) References Cited

U.S. PATENT DOCUMENTS

| | | | | |
|---|---|---|---|---|
| 5,482,863 | A | 1/1996 | Knobel | 436/54 |
| 5,482,864 | A | 1/1996 | Knobel | 436/54 |
| 5,705,062 | A | 1/1998 | Knobel | 210/205 |
| 5,942,124 | A | 8/1999 | Tuunanen | 210/695 |
| 6,020,211 | A | 2/2000 | Tuunanen | 436/526 |
| 6,193,892 | B1 | 2/2001 | Krueger et al. | 210/695 |
| 6,207,463 | B1 | 3/2001 | Tuunanen | 436/526 |
| 6,294,342 | B1 | 9/2001 | Rohr et al. | 435/7.1 |

(Continued)

FOREIGN PATENT DOCUMENTS

| | | | |
|---|---|---|---|
| DE | 31 02 029 | 8/1992 | B01L 9/06 |
| DE | 10 2009 027454 | 1/2011 | A61J 1/00 |

(Continued)

OTHER PUBLICATIONS

Ivo Safarik et at, "Magnetic techniques for the isolation and purification of proteins and peptides", BioMagnetic Research and Technology 2004, 2:7, Published: Nov. 26, 2004, p. 1-17.

(Continued)

*Primary Examiner* — David A Reifsnyder
(74) *Attorney, Agent, or Firm* — Susan S. Wilks; Scott McBride

(57) ABSTRACT

A method and apparatus for separating a non-magnetic material from magnetic material is provided. A magnetic separation device includes at least one magnetic element for producing a magnetic field. The magnetic separation device further includes a first support portion including a threaded opening that threadingly receives a threaded portion of a container to fixedly attach the container to the first support portion in an aligned orientation with respect to the magnetic element. The threaded opening retains the container in the aligned orientation when inverting the magnetic separation device.

17 Claims, 7 Drawing Sheets

(56) References Cited

U.S. PATENT DOCUMENTS

| | | | | |
|---|---|---|---|---|
| 6,558,632 | B1 | 5/2003 | Guller et al. | 422/104 |
| 7,226,537 | B2 | 6/2007 | Broyer et al. | 210/222 |
| 7,785,535 | B2 | 8/2010 | Chen et al. | 422/82 |
| 2010/0225920 | A1 | 9/2010 | Xia et al. | 356/442 |
| 2012/0181285 | A1 | 7/2012 | Krauss et al. | 220/507 |

FOREIGN PATENT DOCUMENTS

| | | | |
|---|---|---|---|
| EP | 0 030 086 | 6/1981 | G01N 33/54 |
| EP | 0 136 126 | 4/1985 | B03C 1/28 |
| WO | 83/00932 | 3/1983 | G01N 37/00 |
| WO | 90/14891 | 12/1990 | B03C 1/02 |
| WO | WO 2013019346 A1 * | 2/2013 | |

OTHER PUBLICATIONS

Patent Cooperation Treaty International Search Report for international application No. PCT/US2012/044534; mailing date Nov. 26, 2012, 15 pages.

* cited by examiner

MAGNETIC SEPARATION DEVICE AND METHODS

CROSS-REFERENCE TO RELATED APPLICATIONS

This application claims the benefit of priority under 35 U.S.C. §119 of U.S. Provisional Application Ser. No. 61/513,265 filed on Jul. 29, 2011 the content of which is relied upon and incorporated herein by reference in its entirety.

TECHNICAL FIELD

The invention relates to apparatus and methods for separation and, more particularly, to apparatus and methods for magnetic separation.

BACKGROUND

It is known to use magnetic bead based separation to separate a desired material within a container. More specifically, a magnetic material can be added to a solution in a container. Desired material can then be associated with the magnetic material. A magnetic device can then be used to separate the magnetic material, together with the associated desired material from the solution in the container.

SUMMARY

The following presents a simplified summary of the disclosure in order to provide a basic understanding of some example aspects described in the detailed description.

In one example aspect of the disclosure, a magnetic separation device is provided comprising at least one magnetic element configured to produce a magnetic field and a first support portion including a threaded opening configured to threadingly receive a threaded portion of a container to fixedly attach the container to the first support portion in an aligned orientation with respect to the magnetic element. The threaded opening is configured to retain the container in the aligned orientation when inverting the magnetic separation device.

In another example aspect of the disclosure, a method of separating a non-magnetic material from magnetic material is provided. The method includes the step of inserting a non-magnetic material and a magnetic material into an interior area of a container. The method further includes the steps of fixedly mounting the container in an aligned orientation relative to a magnetic element and attracting the magnetic material to an interior surface of the container while the container is in the aligned orientation. The method further includes the step of repositioning the container to pour a quantity of the non-magnetic material out of the interior area of the container while retaining a quantity of the magnetic material within the interior area. The container remains in the aligned orientation while repositioning the container.

BRIEF DESCRIPTION OF THE DRAWINGS

These and other aspects are better understood when the following detailed description is read with reference to the accompanying drawings, in which.

DETAILED DESCRIPTION

Figure 1:
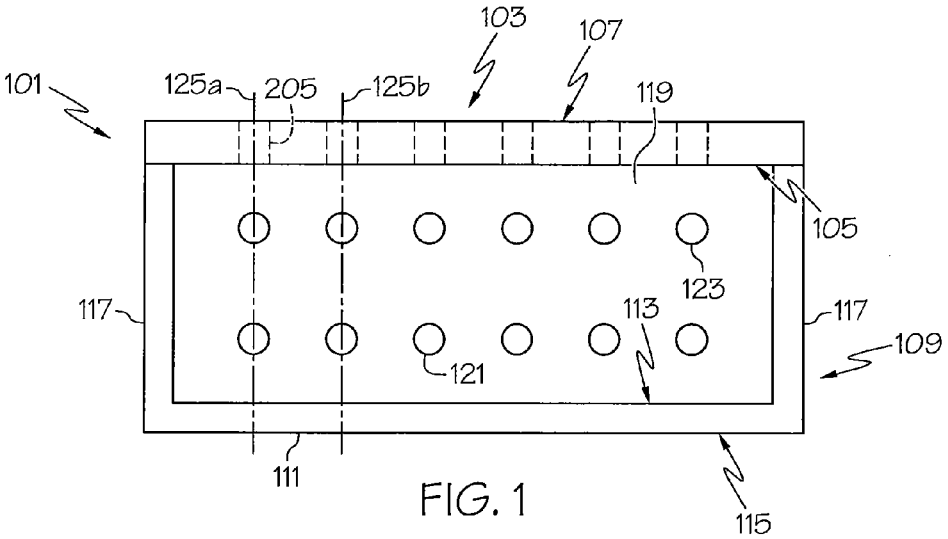
FIG. 1 is a front elevation view of an example magnetic separation device.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

FIG. 1 illustrates a front elevation view of a magnetic separation device 101 incorporating aspects of the disclosure. The magnetic separation device 101 can include a wide variety of configurations including various designs, sizes, shapes or functional features designed to separate a desired material from a non-magnetic material using a magnetic material. The magnetic separation device 101 can be formed from a number of different materials, such as plastic, or the like.

The magnetic separation device 101 can include a carriage 103. The carriage 103 can include a first surface 105 and a second surface 107 that are substantially planar (see FIG. 1). The carriage 103 can have a rectangular shape (see FIG. 2). It is to be understood that the carriage 103 is not limited to the size or shape in the shown examples. For instance, in further examples, the carriage 103 could include a substantially square, oval, circular shape, or the like. Similarly, the carriage 103 is not limited to being substantially planar. In further examples, either or both of the first surface 105 and second surface 107 may extend along a plane that is not parallel to the other of the first surface 105 and the second surface 107. In one example, the second surface 107 could include multiple levels, such as a first level that is non-parallel to a second level. The carriage 103 may comprise a number of different materials, including plastic, or the like. Furthermore, the carriage 103 can comprise a single, integrally formed structure, or multiple structures that, together, comprise the carriage 103.

Figure 2:
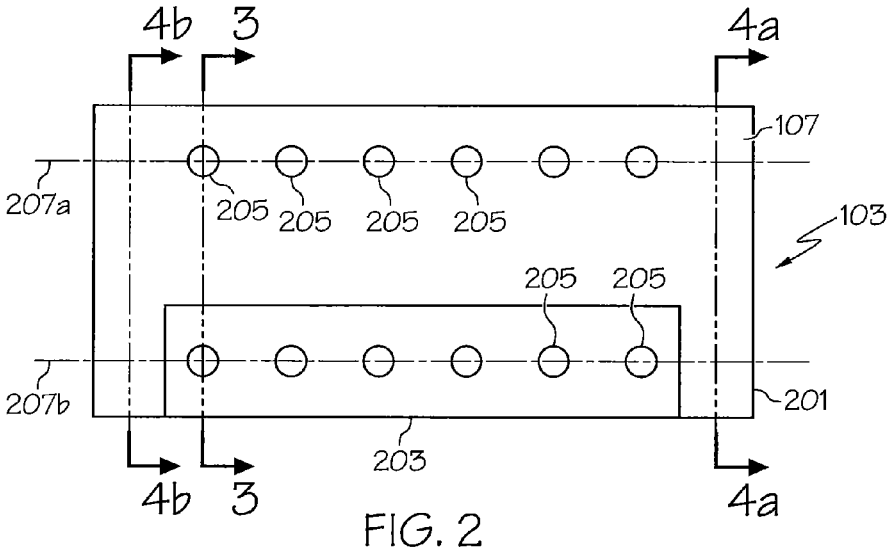
FIG. 2 is a top plan view of the magnetic separation device of FIG. 1.

As shown in FIG. 2, the carriage 103 can comprise a main support portion 201 and a second support portion 203. The main support portion 201 and the second support portion 203 can be removably attached to each other, such that the main support portion 201 and the second support portion 203 comprise separate pieces. The main support portion 201 can include a recess, cavity, or the like that is sized and shaped to receive the second support portion 203.

The second support portion 203 can be removably attached to the main support portion 201. Specifically, the second support portion 203 can be selectively attached (see FIGS. 2 and 3) or removed (see FIG. 6) from the main support portion 201. The second support portion 203 can be sized and shaped to fit within the recess of the main support portion 201. As such, when the second support portion 203 is attached to the main support portion 201, the main support portion 201 and the second support portion 203 are substantially flush with each other such that a substantially planar surface is formed. The second support portion 203 can be rectangularly shaped, though, other sizes and shapes are configured. For instance, the second support portion 203 could be larger or smaller in size, and/or could take on a number of shapes, such as a square shape, half-circle shape, etc. It is to be understood that the recess in the main support portion 201 can be sized and shaped to match the shape in the second support portion 203. Accordingly, in one example, the recess in the main support portion 201 can comprise a rectangular shape when the second support portion 203 can comprise a similar rectangular shape.

Figure 3:
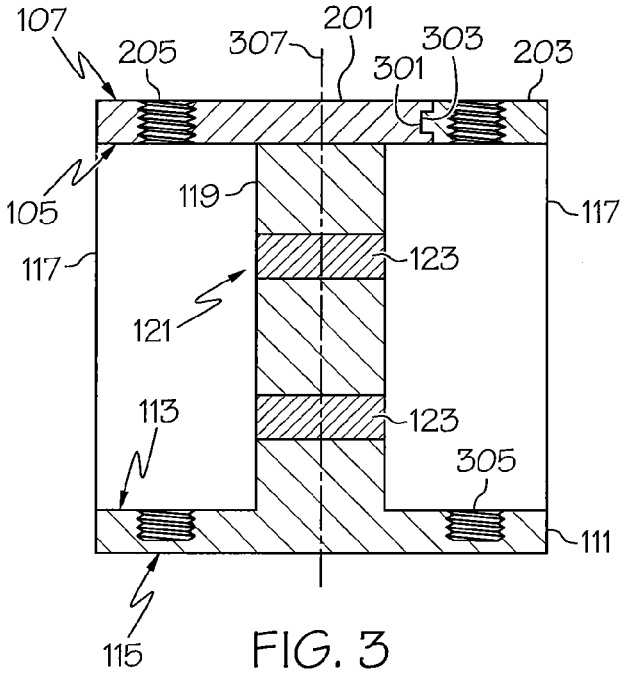
FIG. 3 is a sectional view of the magnetic separation device along line 3-3 of FIG. 2.

The main support portion 201 and the second support portion 203 can be attached, such as removably attached, to each other using any number of attachment structures. In one example, a tongue and groove structure may be provided wherein one of the support portions includes the tongue and the other of the support portions includes the groove. For instance, as shown in FIG. 3, the main support portion 201 can include a groove 303 while the second support portion 203 can include a tongue 301. The tongue 301 can protrude from a side of the second support portion 203. The tongue 301 can extend partially or completely around the second support portion 203. It is contemplated that a single tongue 301 can be provided extending partially or completely around the second support portion 203 or a plurality of tongues be provided extending partially or completely around the second support portion 203. The tongue 301 can be provided on the side of the second support portion 203 that makes contact with and engages with the groove 303 of the main support portion 201. As such, the tongue 301 can project outwardly along one side, two sides, or three sides of the second support portion 203. The tongue 301 can comprise a square shape, as shown, or can include a variety of other shapes, such as a triangle, rectangle, or the like.

The main support portion 201 can include the groove 303 that may extend partially or completely around a side of the recess. The groove 303 can be sized and shaped to match or be slightly larger than the size and shape of the tongue 301 of the second support portion 203. The groove 303 can project inwardly from the side of the recess towards an interior portion of the main support portion 201. The groove 303 can extend along portions of the recess that match the locations of the tongue 301. For instance, if the tongue 301 extends along three sides of the second support portion 203, then the groove 303 can extend along all three sides of the recess. As such, the tongue 301 can engage and project into the groove 303 when the second support portion 203 is attached to the main support portion 201.

In another example, a snapping connection, latching mechanism or other attachment mechanism may be used to attach the main support portion 201 to the second support portion 203. Furthermore, removable attachment may be provided wherein the second support portion 203 may be subsequently removed from the main support portion 201 sometime after attachment. Moreover, attachment may limit, such as prevent relative movement between the main support portion 201 and the second support portion 203. For example, the tongue and groove arrangement may prevent limit movement in one direction while allowing sliding movement during the attachment step. Moreover, once in the appropriate position, a snapping connection may be provided to help inhibit premature removal of the second support portion from the main support portion. In further examples, the attachment may be permanent wherein, once attached, removal of the second support portion from the main support portion may not be possible without damaging the support portions.

In still further examples, the second support portion may be an optional component or may not be provided at all. As such, the entire support portion may comprise a single support portion. Alternatively, the second support portion may be provided as an optional attachment to increase the quantity of containers that may simultaneously undergo the separation procedure.

As shown in FIG. 2, the carriage 103 can further include one or more openings 205. In one example, the one or more openings 205 can extend completely through the carriage 103 (see FIG. 3) from the first surface 105 to the second surface 107. In one example, the openings 205 comprise circular shapes although other shapes may be used in further examples. Moreover, the openings may include substantially identical dimensions (e.g., internal diameters if circular) to accommodate containers of similar or identical sizes. Alternatively, the openings may include different dimensions (e.g., different internal diameters) to allow processing of containers having different sizes. As shown, the one or more openings 205 can be include a structure for fixedly mounting with a container. For example, as shown, the openings 205 can each include the illustrated internal thread, along an internal surface of the one or more openings 205. As such, in the illustrated example, the one or more openings 205 can comprise threaded openings although other fixing structures may be provided in further examples.

The one or more openings 205 are shown to include a plurality of openings 205 and, more specifically, twelve openings although any number of one or more openings may be provided in accordance with aspects of the disclosure. A portion of the one or more openings 205 can extend along a first axis 207*a* while another portion of the one or more openings 205 can extend along a separate second axis 207*b*. As shown in FIG. 2, a first set of six of the one or more openings 205 can extend along a substantially linear first axis 207*a* that is positioned on the main support portion 201. A second set of six of the one or more openings 205 can extend along a substantially linear second axis 207*b* positioned on the second support portion 203. The one or more openings 205 are not limited to extending along a linear axis, and could extend along a non-linear axis, such as by being staggered, or the like.

The one or more openings 205 are not limited to twelve openings as shown, and could include more openings or fewer openings. For instance, the first set of the one or more openings 205 could include more than six openings or less than six openings while the second set of the one or more openings 205 could similarly include more than six openings or less than six openings. Each of the one or more openings 205 can be spaced apart from an adjacent opening 205. In one example, spacing between adjacent openings 205 could be around 18 millimeters, however, a variety of distances is contemplated. Moreover, as shown, the spacing of the openings 205 is identical although different spacings may be provided in further examples.

Figure 4:
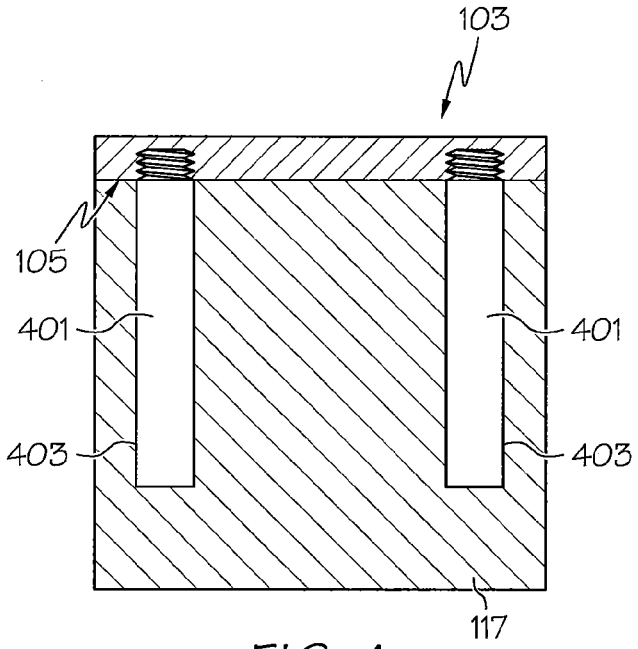
FIG. 4 is a sectional view of the magnetic separation device along either of lines 4*a*-4*a* or 4*b*-4*b* of FIG. 2.

As shown in FIG. 4, the carriage 103 can further include legs 401. The legs 401 can be formed integrally with the carriage 103 as a single piece or, in the alternative, can be separately attached. As shown, the legs 401 can be attached to the first surface 105, for example, by the illustrated threaded connection, and can project outwardly from the first surface 105. The legs 401 can be positioned at opposing ends of the carriage 103 although the legs may be positioned at other locations, such as central portions of the carriage. The legs 401 can include any number of legs. For instance, FIG. 4 illustrates an example with a total of four legs with two legs positioned at one end and two legs positioned at an opposing end. However, the legs 401 could a total of two or more legs in a wide range of locations. Providing two or more legs can help inhibit rotation of the carriage. In further examples, a single leg may be provided. In such examples, the leg may have a noncircular shape to prevent relative rotation of the carriage with respect to other parts of the magnetic separation device 101. As such, the legs 401, if provided, can take on a variety of sizes, shapes, and lengths, and are not limited to the shown examples.

Referring back to FIG. 1, the magnetic separation device 101 can further include a base 109 that, in one example, can be removably attached to the carriage 103. The base 109 can include a supporting structure 111 (see FIG. 3). The supporting structure 111 can comprise a substantially planar structure although nonplanar configurations may be use. A planar structure may be desired in examples where the magnetic separation device 101 is to be supported on a planar surface, such as a table. In such examples, the orientation of the containers being supported by the magnetic separation device 101 can be adjusted or maintained at a desired orientation during separation. As such, the supporting structure 111 can include a first side 113 and a second side 115 that is opposite from the first side 113. In one example, at least the second side 115 can be substantially planar, such that the second side 115 can be placed on a flat surface and support the magnetic separation device 101.

The supporting structure 111 can have a rectangular shape, though other sizes and shapes are contemplated. In one example, the supporting structure 111 can include a size, shape, length and/or width that is substantially similar or identical to the size, shape, length, and/or width of the rectangular carriage 103. In further examples, the supporting structure 111 can comprise a substantially square, oval, circular shape, or the like.

In addition or alternatively to the openings 205 in the carriage 103, as shown in FIG. 3, the supporting structure 111 of the base 109 can further or alternatively include one or more base openings 305. The base openings 305 can be positioned on the first side 113 of the supporting structure 111 and can extend partially or completely through the supporting structure 111. In the shown example, the base openings 305 can extend from the first side 113 at a surface of the supporting structure 111 to an interior portion of the supporting structure 111. The base openings 305 can be substantially similar or identical in structure to the one or more openings 205 in the carriage 103. For instance, the base openings 305 can comprise a circular shape. The base openings 305 can further include a threading positioned along an internal surface of the base openings 305, such that the base openings 305 comprise threaded openings. The base openings 305 are shown to include a female threading, but as with the openings 205, are not limited to the structure as shown.

The base openings 305 can be positioned to follow the pattern of the one or more openings 205 in the carriage 103 in FIG. 2. Specifically, the an axis extending through a center of each of the one or more openings 205 can extend through a center of one of the base openings 305 positioned on the supporting structure 111. Accordingly, the base openings 305 can be positioned directly underneath the one or more openings 205. As such, either of the openings 205, 305 may be used to provide appropriate alignment of the container as discussed more fully below. Moreover, while the illustrated example shows the magnetic separation device including both carriage openings 205 and base openings 305, in further examples, the magnetic separation device may only include base openings 305 or may only include carriage openings 205. Still further, although a removable carriage 103 is illustrated, in further examples, a support member may be provided that is integral or otherwise attached to the base. In such examples, the openings 205 may be an integral part of the entire magnetic separation device wherein the openings may not be move relative to the magnets that can be provided in examples provided with a carriage.

As shown in FIG. 1, the base 109 may be provided with a pair of lateral support members 117. If provided, the lateral support members 117 can extend from the first side 113 of the supporting structure 111 in a direction extending away from the first side 113. The lateral support members 117 can be positioned at opposing ends of the supporting structure 111. The lateral support members 117 are positioned such that an open area can extend between the lateral support members 117. Although not required in all examples, the lateral support members 117 may provide increased rigidity and/or help protect containers fixed to the magnetic separation device.

The lateral support members 117, if provided, can further include one or more leg openings 403 for receiving the legs 401 of the carriage 103. The leg openings 403 can comprise a recess, opening, aperture, or the like, and can extend partially through the lateral support members 117. The leg openings 403 can be sized and shaped to receive the legs 401, and could be slightly larger in size than the legs 401 such that a snug fit between the legs 401 and the leg openings 403 can be provided. Similarly, the number of leg openings 403 in the supporting structure 111 can be equal to or greater than the number of legs 401 provided in the carriage 103. Providing more leg openings than legs can provide optional mounting capability for the carriage 103. Alternatively, providing the same number of leg openings as legs can guarantee proper alignment of the containers relative to the magnet elements.

The legs 401 can be selectively inserted and removed from the leg openings 403. For instance, when the legs 401 are inserted into the leg openings 403, such as in an attached position, the carriage 103 is mounted to the base 109. In the attached position, lateral movement of the carriage 103 is limited, and, in some examples, the carriage 103 can be designed for selective movement in the vertical direction. In one example, the carriage 103 is latched into position wherein the carriage resists vertical movement to slide the legs 401 out of the leg openings 403. If desired, the carriage may be unlatched, such that the carriage 103 can be removed from the base 109 by moving the carriage 103, such as by lifting, in the direction longitudinal to the direction along which the legs 401 and leg openings 403 extend. As such, the carriage 103 can be moved between an attached and detached position with respect to the base 109.

As shown in FIG. 1, the base 109 can further include a central support member 119. The central support member 119 can extend from the first side 113 of the supporting structure 111 in a direction substantially perpendicular to the first side 113. The central support member 119 can extend between the optional lateral support members 117. More specifically, the central support member 119 can be attached and/or integrally formed with one of the lateral support members 117 at one end and with the other of the lateral support members 117 at an opposing end. The central support member 119 can extend along a length of the supporting structure 111. In one example, the central support member 119 can extend from a midpoint of the supporting structure 111 (see FIG. 3). However, it is to be understood that the central support member 119 can be offset from the midpoint of the supporting structure 111 in further examples. The central support member 119 can be formed as a single piece with the supporting structure 111 and/or the lateral support members 117 or can be attached as a separate piece. Similar to the lateral support members 117, the central support member 119 can be attached to the supporting structure 111 and/or to the lateral support members 117 with any number of attachment structures, such as adhesives, screws, snap fit means, or the like.

Referring to FIGS. 1 and 3, the central support member 119 can further include one or more magnet openings 121. The magnet openings 121 can extend partially or completely across the central support member 119. The magnet openings 121 can comprise a first row and a second row of magnet openings 121. As shown, each of the first row and the second row can include six magnet openings 121. The magnet openings 121 can be aligned in a column defined by a separating axis 125*a*, such that there are six columns. Specifically, one magnet opening 121 can be positioned above a second magnet opening 121 with the separating axis 125*a* extending through the two magnet openings 121. Likewise, another pair of magnet openings 121 may be aligned along another separating axis 125*b* adjacent to the first separating axis 125*a*. The separating axis 125*a*, 125*b* can be perpendicular to the first surface 105 and the first side 113. While only one separating axis 125 is shown, it is to be understood that each of the columns having magnet openings 121 is oriented substantially identically with respect to a corresponding separating axis. In addition, one of the one or more openings 205 and one of the one or more base openings 305 can be aligned with a column of the magnet openings 121. As such, a corresponding separating axis 125*a*, 125*b* can extend through each of the one opening 205, one base opening 305, and two magnet openings 121.

It is to be understood that the number of magnet openings 121 and the number of rows of magnet openings 121 is not limited to the example described herein. For instance, more magnet openings 121 or fewer magnet openings 121 are contemplated. Similarly, more than two rows of magnet openings 121 or as few as one row of magnet openings 121 are also contemplated.

As shown in FIGS. 1 and 3, the base 109 can support one or more magnetic elements 123. The magnetic elements 123 can be mounted to the central support member 119 of the base 109 by being inserted into the magnet openings 121. The magnetic elements 123 can be sized to have a diameter that is slightly larger than a diameter of the magnet openings 121. As such, the magnetic elements 123 can be press fit or otherwise secured to the magnet openings 121 without falling out. In a further example, an attachment structure can assist in attaching the magnetic elements 123 to the magnet openings 121. The attachment structure could include an adhesive, epoxy, snap fit means, or the like, that can provide additional support in attaching the magnetic elements 123 to the magnet openings 121. It is to be understood that the magnetic elements 123 are not limited to being positioned within the central support member 119. In further examples, one or more of the lateral support members 117 and/or the supporting structure 111 could include one or more magnetic elements 123.

Once attached to the magnet openings 121, the magnetic elements 123 are positioned at the same location as the magnet openings 121. More specifically, the magnetic elements 123 can be oriented in a plurality of columns, with two magnetic elements 123 in each column. As such, one magnetic element 123 can be positioned above a second magnetic element with the separating axis 125 extending through the two magnetic elements 123. Accordingly, as described above, the separating axis 125 can extend through each of the one opening 205, one base opening 305, and the column having two magnetic elements 123. Providing a plurality of magnetic elements 123 along the separating axis 125 can help facilitate separation of magnetic material 603 from a relatively long container 501 discussed and illustrated with respect to FIG. 6 below. Furthermore, a plurality of magnetic elements 123 along the separating axis 125 can allow relatively short containers to be used. For instance, with reference to FIG. 6, a much shorter container 501 may be used, wherein the upper magnetic element 123 can still be effective to facilitate separation of the magnetic material from the relatively short containers. Furthermore, at least one of the magnetic elements 123 can be designed to be positioned adjacent the lower end of the container. As such, the magnetic elements 123 may act on the magnetic material that collects near the bottom of the container under the influence of gravity to make use of the magnets more effective.

Moreover, as shown in FIG. 3, the ends of the magnetic elements 123 can be flush with corresponding surfaces of the central support member 119. In further examples, the ends of the magnetic elements 123 may be recessed within the corresponding surfaces of the central support member 119. In still further examples, the ends of the magnetic elements 123 may protrude from the corresponding surfaces of the central support member 119. In some examples, the magnetic elements 123 may be mounted such that the ends of the magnetic elements 123 protrude a predetermined distance from the surfaces of the central support member 119. As such, the ends of the magnetic elements 123, in some examples, may be designed to engage or be positioned immediately adjacent to containers 501 discussed below to help facilitate attraction of magnetic material 603 as discussed below.

The magnetic elements 123 can include a number of different magnetic materials that can produce a magnetic field. For instance, the magnetic elements 123 can comprise a permanent magnet, an electro magnet, a rare earth magnet, or the like. Similarly, while a plurality of magnetic elements 123 are shown in the illustrated examples, it is to be understood that a single magnetic element could be provided instead. The magnetic elements 123 are attached to the base 109 can produce a magnetic field. As shown in FIG. 3, a single magnet may be provided to present a field at opposite sides of the central support member 119 although a plurality of magnets may be provided in further examples.

Figure 5:
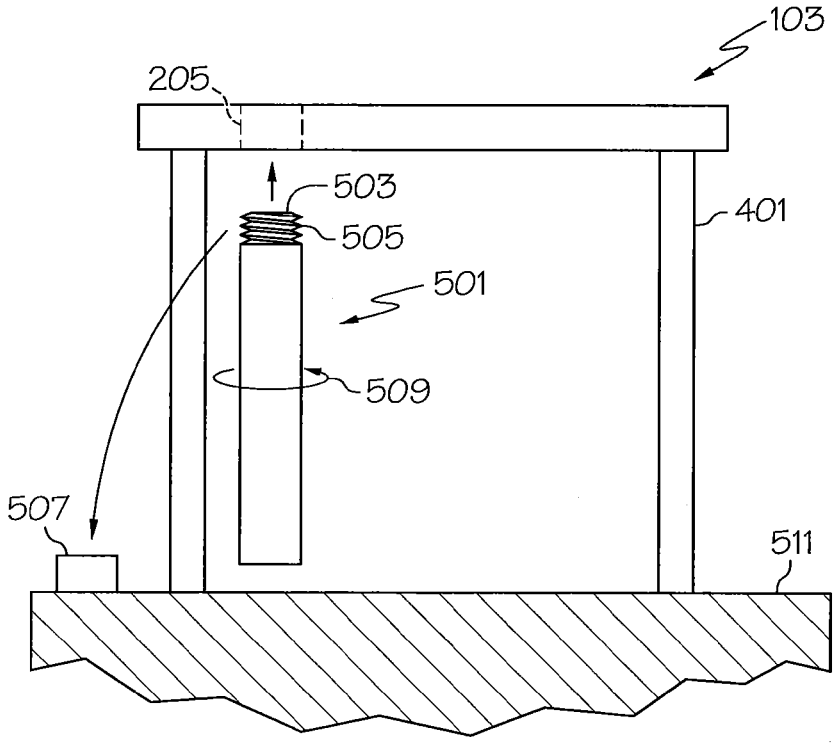
FIG. 5 illustrates an example step of fixedly mounting a container to a carriage of the magnetic separation device of FIG. 1.
Figure 6:
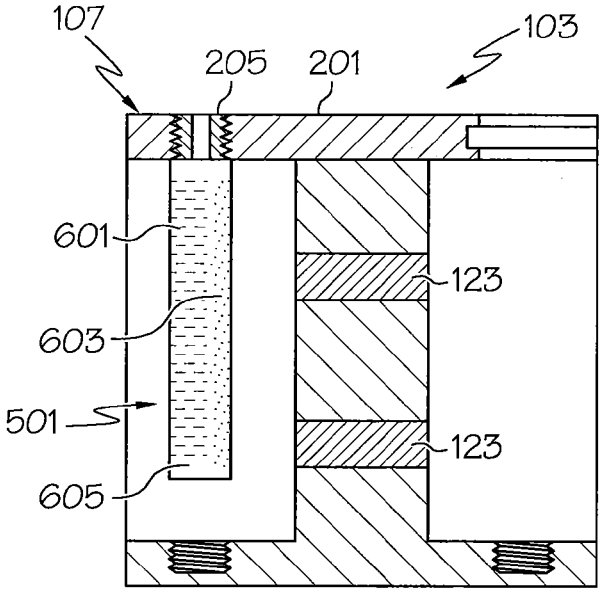
FIG. 6 illustrates the carriage of FIG. 5 being mounted to a base such that the container achieves an aligned orientation relative to a magnetic element.
Figure 7:
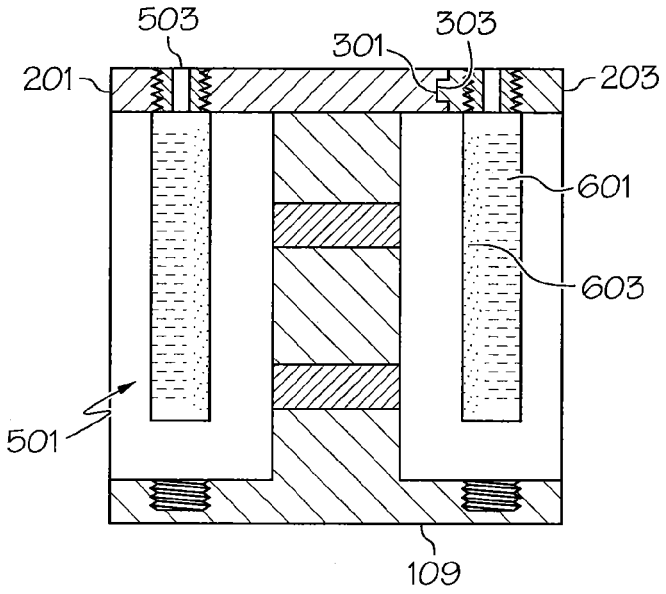
FIG. 7 illustrates the optional step of releasably attaching a second support portion to a first support portion of FIG. 6.

Referring to FIGS. 5-7, the magnetic separation device 101 accommodates a container 501. The container 501 can include a variety of structures that can hold a substance. The container 501 can be substantially circular and have a wall surrounding an interior area 605. The container 501 can include an opening 503 positioned at one end such that the interior area 605 can be accessed through the opening 503. In the shown examples, the container 501 can further include a threaded portion 505. The threaded portion 505 can be positioned at either or both ends of the container 501. For instance, the threaded portion 505 can be disposed at the end of the container 501 that is adjacent the opening 503 (see FIG. 5). In another example, a container 1001 can include a threaded portion 1003 that is disposed at an end of the container 1001 that is opposite from an opening 1005 (see FIG. 10). In yet another example, both ends of a container could include threaded portions.

The threaded portion 505, 1003 can be sized to be threadingly received by either of the one or more openings 205 in the carriage 103 or the base openings 305 in the base 109. For instance, when the threaded portion 505, 1003 is received by the one or more openings 205 or the base openings 305, then the container 501, 1001 can be fixedly suspended from the carriage 103 (e.g., see FIGS. 6-7) or fixedly supported by the base 109 (e.g., see FIG. 11). By being fixedly suspended or fixedly supported, the container 501, 1001 can be prevented from being inadvertently detached from the carriage 103 and/or the base 109. Moreover, the aligned orientation of the container 501, 1001 can be maintained while pouring out the liquid after separation has been obtained within the container. In one example, the threaded portions 505, 1003 can comprise a male threaded portion while the one or more openings 205 and the base openings 305 can comprise female receiving threaded portions. As such, the threaded portion 505, 1003 of the container 501, 1001 can be attached to either of the carriage 103 or the base 109 by screwing the threaded portion 505, 1003 into one of the one or more openings 205 or the base openings 305. Once the threaded portion 505, 1003 is threadingly received by the one or more openings 205 or the base openings 305, the container 501, 1001 is fixedly attached to the carriage 103 or the base 109.

Referring now to FIGS. 6 and 7, the container 501, 1001 can receive a material, such as a liquid, fluid, solid, or the like, through the opening 503, 1005. Once the material is inserted through the opening 503, 1005, the material can be held within the interior area 605. The material can comprise a mixture including either or both of a non-magnetic material 601 and a magnetic material 603. The non-magnetic material 601 can include a variety of materials, such as a liquid, fluid, or the like. For instance, the non-magnetic material 601 can include, but is not limited to, a biological solution such as blood, urine, tissue, cells, macromolecules such as nucleic acid cell based assays, antibody and protein purifications, or the like. The magnetic material 603, which can include magnetic beads or the like, can be added to the non-magnetic material 601 in the container 501, 1001. After the non-magnetic material 601 and the magnetic material 603 are added, the magnetic material 603 can attract a desired material from the non-magnetic material 601. The desired material can attach to the magnetic material 603, such that the desired material is separated from the non-magnetic material.

Methods of separating the non-magnetic material 601 from the magnetic material 603 can now be discussed with reference to the carriage 103 of FIG. 5. As shown, the container 501 can initially be provided having the non-magnetic material 601 and the magnetic material 603 within the interior area 605. Either the non-magnetic material 601 or the magnetic material 603 can be added first to the container 501 through the opening 503 or, alternatively, the non-magnetic material 601 and the magnetic material 603 can be added together at the same time, such as in a mixture. The non-magnetic material 601 and the magnetic material 603 can interact with each other, such that a quantity of the non-magnetic material 601, which may include the desired material, can engage and/or bind with the magnetic material 603.

The carriage 103 can optionally initially rest on a surface 511 while remaining detached from the base 109. An end cap 507 can be removed from the threaded portion 505 of the container 501. The container 501 can be aligned with one of the one or more openings 205 in the carriage 103. The container 501 can be rotated in a direction 509 such that the threaded portion 505 rotatably and threadingly engages the one of the one or more openings 205. It is to be understood that the direction 509 could be clockwise or counterclockwise, and the arrow in the shown example is not intended to be limiting. The container 501 can continue to be rotated until the container 501 is fixedly mounted to the carriage 103. Accordingly, the container 501 can be fixedly mounted to the carriage 103 by screwing the threaded portion 505 into the threaded opening 205 of either or both of the main support portion 201 or the second support portion 203. Once the container 501 is fixedly mounted to the carriage 103, the opening 503 in the container 501 can extend at least partially through the opening 205 in the carriage 103. In further examples, the container 501 can be screwed into the carriage 103 such that the edge defining the opening 503 is substantially flush with the second surface 107. In this example, the opening 503 may not extend past the second surface 107, such that the second surface 107 and edges of the opening 503 form a substantially planar surface.

Referring now to FIG. 6, the method can then optionally proceed to the step of fixedly mounting the container 501 in an aligned orientation relative to the magnetic elements 123. After the container is fixedly mounted to the carriage 103, the carriage 103 can be attached to the base 109, such as by inserting the legs 401 into the leg openings 403. Once attached, the container 501 can be retained in the aligned orientation relative to the magnetic elements 123. As shown, the container 501 can project from the main support portion 201 towards the supporting structure 111. The container can extend along a side of the central support member 119 such that the container is in proximity to the magnetic elements 123. Accordingly, in the aligned orientation, the container 501 can project parallel to and along the separating axis 125 such that the container 501 is positioned close enough in proximity to the magnetic elements 123 that the contents of the container 501 can be at least partially within the magnetic field. In this example, while in the aligned orientation, the contents of the container, including either or both of the non-magnetic material 601 and the magnetic material 603, can be influenced by the magnetic field and the magnetic elements 123.

Referring now to FIG. 7, the method can then optionally proceed to the step of attaching the second support portion 203 to the main support portion 201. While FIG. 6 does not include the second support portion 203, it is to be understood that the second support portion 203 can optionally be provided, or, in the alternative, the carriage 103 may not include the second support portion 203. In the shown example of FIG. 7, the container 501 can be fixedly mounted to the second support portion 203. It is it to be understood, however, in further examples, that the second support portion 203 may not include the container 501 and could be attached to the main support portion 201 with some or all of the openings 205 not having containers 501. Accordingly, the second support portion 203 can be attached to the main support portion 201 independently of the presence of containers 501 attached to the second support portion 203 and/or the main support portion 201.

The second support portion 203 can be attached to the main support portion 201 by inserting the second support portion 203 in a direction transverse to the central axis 307 (see FIG.

3). The second support portion 203 can first be aligned with the recess in the main support portion 201. Next, the second support portion 203 can be moved towards the main support portion 201 in the transverse direction, such as perpendicular to, the central axis 307. The second support portion 203 can be moved into engagement with the main support portion 201 until the groove 303 receives the tongue 301. Once the tongue 301 partially or fully enters the groove 303, the second support portion 203 is attached to the main support portion 201.

If the second support portion 203 includes one or more containers 501, the one or more containers can be in the aligned orientation once the second support portion 203 is attached to the main support portion 201. Similar to the example discussed above with respect to FIG. 6, the containers 501 that are attached to the second support portion 203 can project parallel to and along the separating axis 125*a*, 125*b* such that the containers 501 are positioned close enough in proximity to the magnetic elements 123 that the contents of the containers 501 can be at least partially within the magnetic field. Accordingly, in the aligned orientation, the contents of the containers 501 held by the second support portion 203, including either or both of the non-magnetic material 601 and the magnetic material 603, can be influenced by the magnetic field and the magnetic elements 123.

Referring now to FIGS. 6 and 7, the method can then optionally proceed to the step of attracting the magnetic material 603 to an interior surface of the container 501 while the container 501 is in the aligned orientation. Since the non-magnetic material 601 and the magnetic material 603 can each be influenced by the magnetic field and the magnetic elements 123 in the aligned orientation, the magnetic material 603 can be attracted towards the magnetic elements 123. As shown, the magnetic material 603 can accumulate on or near an interior surface surrounding the interior area 605 that is closest in proximity to the magnetic elements 123. The magnetic material 603 can accumulate along a portion or substantially the entire length of the container 501 at the interior surface.

Figure 8:
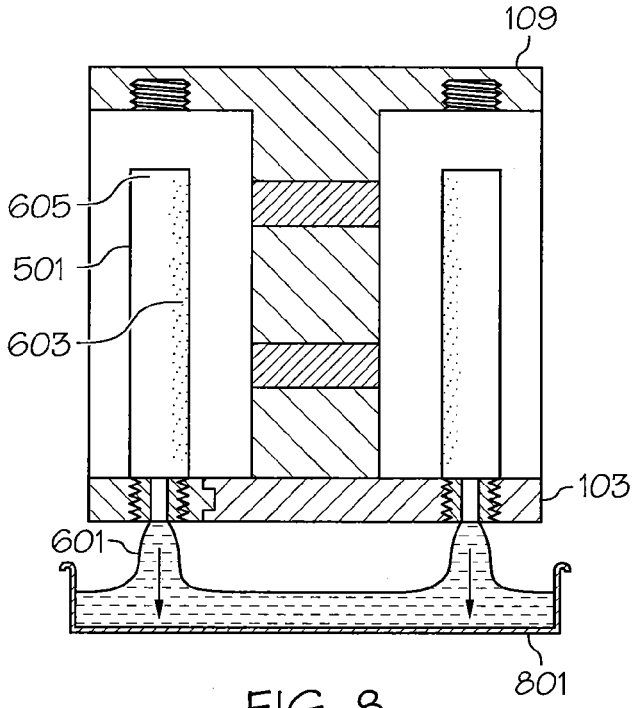
FIG. 8 illustrates an example step of repositioning the magnetic separation device of FIG. 7 to pour a quantity of non-magnetic material out of an interior area of the container.

Referring now to FIG. 8, the method can then optionally proceed to the step of repositioning the container 501 to pour a quantity of the non-magnetic material 601 out of the interior area 605 while retaining a quantity of the magnetic material 603 within the interior area 605. The magnetic separation device 101 can be repositioned, such as by rotating or inverting the magnetic separation device 101. When the magnetic separation device 101 is repositioned, the container 501 can also be repositioned since the container is attached to the carriage 103. The container 501 can remain in the aligned orientation even while repositioned, rotated, or the like, due to the container 501 being fixedly attached to the carriage 103. As such, in the aligned orientation, the magnetic material 603 can remain attracted to the interior surface of the container 501 even when pouring out the non-magnetic material 601.

When the container 501 is repositioned, the magnetic material 603 can remain attracted to the interior surface of the container 501 while a quantity of the non-magnetic material 601 can be poured out of the container 501 through the opening 503. A separate quantity of the non-magnetic material 601, which can include the desired material, can remain attached to the magnetic material 603 within the container 501. As such, a quantity of the non-magnetic material 601 is poured out of the container while a second quantity of the non-magnetic material remains attached to the magnetic material 603 on the interior surface of the container 501.

The quantity of non-magnetic material 601 can be poured into a receiving device 801. The receiving device 801 is only generically/schematically shown, and is not limited to the examples shown herein. For instance, the receiving device 801 can include nearly any type of receptacle (e.g., dish, tube, bottle, or the like). Similarly, while one receiving device 801 is shown, a plurality of receiving devices can be provided such that the receiving device 801 can comprise one or more receiving devices.

Figure 9:
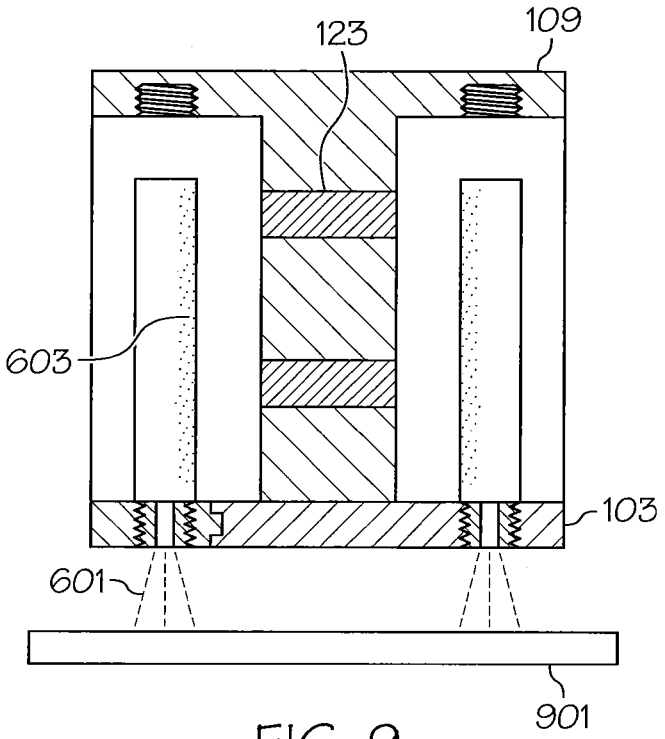
FIG. 9 illustrates an optional step of using an absorbent material to remove an additional quantity of the non-magnetic material.

Referring now to FIG. 9, the method can then optionally proceed to the step of depositing a quantity of the non-magnetic material 601 onto an absorbent material 901. After a majority of the non-magnetic material 601 has been removed from the container 501, an excess quantity of non-magnetic material 601 can further be removed from the container 501. In this example, the absorbent material 901 can be provided and positioned underneath one or more of the openings 503. A user can shake, tap, and/or move the magnetic separation device 101 such that the excess quantity of the non-magnetic material 601 can pour out of the opening 503 and onto the absorbent material 901. At the same time, the container 501 can retain the aligned orientation such that the magnetic material 603 can remain attracted to the interior surface of the container 501 due to the fixed attachment.

Referring now to FIGS. 10-13, further example methods of separating the non-magnetic material 601 from the magnetic material 603 can now be discussed. In this example method, the container 1001 can be attached to the base 109 instead of the carriage 103. The attachment and pouring steps can be substantially the same and/or identical to the steps described above, but will be described in detail below.

Figure 10:
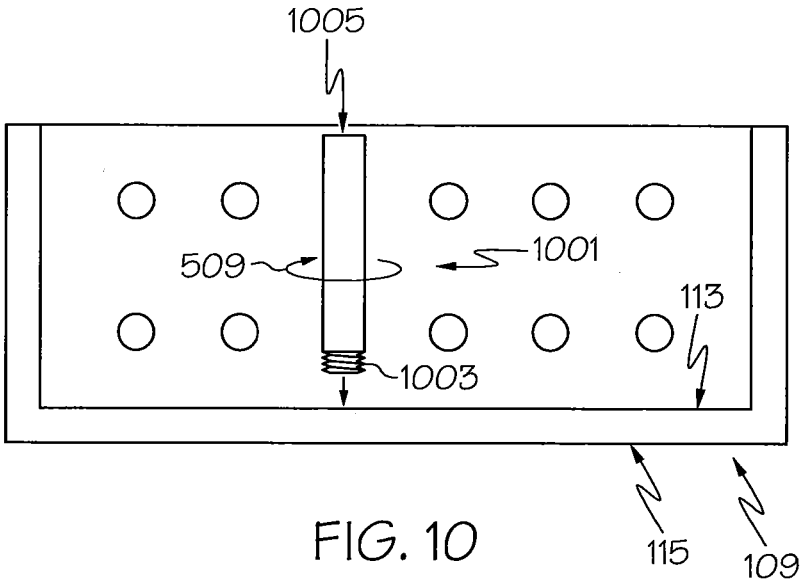
FIG. 10 illustrates a container being fixedly mounted to a base of the magnetic separation device of FIG. 1.

As shown in FIG. 10, the container 1001 can include the opening 1005 at a first end and the threaded portion 1003 at an opposed second end. The container 1001 can initially be provided having the non-magnetic material 601 and the magnetic material 603 within the interior area 605. Either the non-magnetic material 601 or the magnetic material 603 can be added first to the container 1001 through the opening 1005 or, alternatively, the non-magnetic material 601 and the magnetic material 603 can be added together at the same time, such as in a mixture. The non-magnetic material 601 and the magnetic material 603 can interact with each other, such that a quantity of the non-magnetic material 601, which may include the desired material, can engage and/or bind with the magnetic material 603.

The base 109 can initially rest on a surface while remaining detached from the carriage 103 although the carriage may not be used. The end cap 507 (see FIG. 5) can be removed from the threaded portion 1003 of the container 1001. The container 1001 can be aligned with one of the one or more base openings 305 in the base 109. The container 1001 can be rotated in a direction 509 such that the threaded portion 1003 rotatably and threadingly engages the one of the one or more base openings 305. The container 1001 can continue to be rotated until the container 1001 is fixedly mounted to the base 109. Accordingly, the container 1001 can be fixedly mounted to the base 109 by screwing the threaded portion 1003 into the base opening 305 of the base 109.

Figure 11:
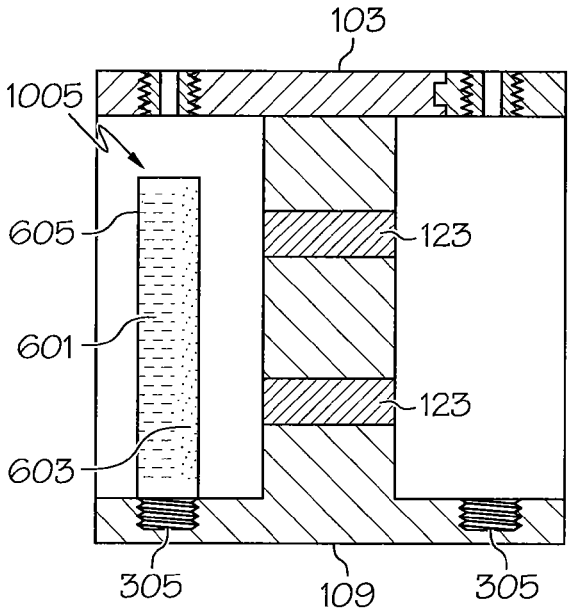
FIG. 11 illustrates the container being fixedly mounted in an aligned orientation relative to a magnetic element of the magnetic separation device of FIG. 10.

Referring now to FIG. 11, the method can then optionally proceed to the step of fixedly mounting the container 1001 in an aligned orientation relative to the magnetic elements 123. After the container 1001 is fixedly mounted to the base 109, the carriage 103 can optionally be attached to the base 109, such as by inserting the legs 401 into the leg openings 403. Once attached, the container 1001 can be retained in the aligned orientation relative to the magnetic elements 123. As shown, the container 1001 can extend along a side of the central support member 119 such that the container 1001 is in proximity to the magnetic elements 123. Accordingly, in the aligned orientation, the container 1001 can project parallel to and along the separating axis 125*a*, 125*b* such that the container 1001 is positioned close enough in proximity to the magnetic elements 123 that the contents of the container 1001 can be at least partially within the magnetic field. In this example, while in the aligned orientation, the contents of the container 1001, including either or both of the non-magnetic material 601 and the magnetic material 603, can be influenced by the magnetic field and the magnetic elements 123.

Referring still to FIG. 11, the method can then optionally proceed to the step of attracting the magnetic material 603 to an interior surface of the container 1001 while the container 1001 is in the aligned orientation. Since the non-magnetic material 601 and the magnetic material 603 can each be influenced by the magnetic field and the magnetic elements 123 in the aligned orientation, the magnetic material 603 can be attracted towards the magnetic elements 123. As shown, the magnetic material 603 can accumulate on or near an interior surface surrounding the interior area 605 that is closest in proximity to the magnetic elements 123. The magnetic material 603 can accumulate along a portion or substantially the entire length of the container 1001 at the interior surface.

Figure 12:
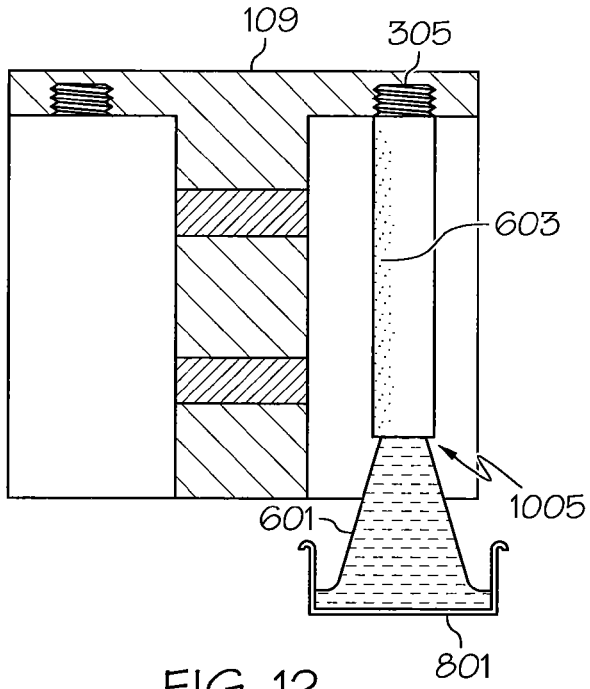
FIG. 12 illustrates an example step of repositioning the magnetic separation device of FIG. 11 to pour a quantity of the non-magnetic material out of the interior area of the container.

Referring now to FIG. 12, the method can then optionally proceed to the step of repositioning the container 1001 to pour a quantity of the non-magnetic material 601 out of the interior area 605 while retaining a quantity of the magnetic material 603 within the interior area 605. The magnetic separation device 101 can be repositioned, such as by rotating or inverting the magnetic separation device 101. When the magnetic separation device 101 is repositioned, the container 1001 can also be repositioned since the container is attached to the base 109. The container 1001 can remain in the aligned orientation even while repositioned, rotated, or the like, due to the container 1001 being fixedly attached to the base 109. As such, in the aligned orientation, the magnetic material 603 can remain attracted to the interior surface of the container 1001.

Figure 13:
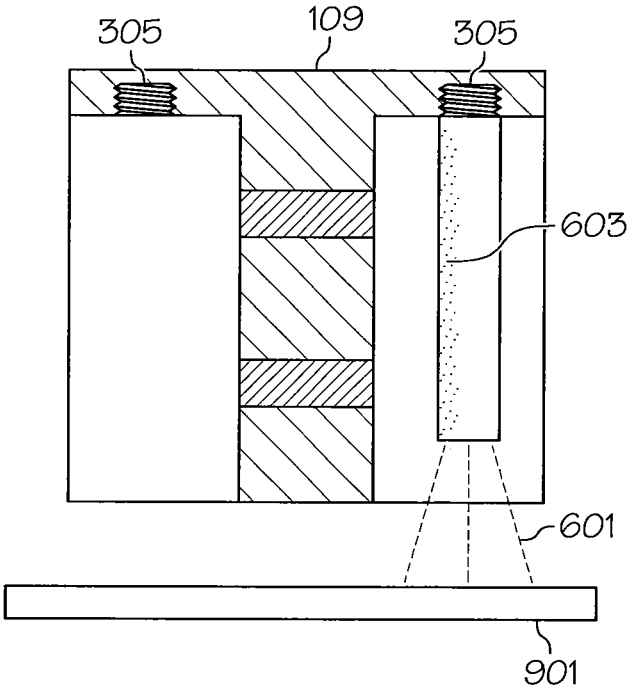
FIG. 13 illustrates a method of using an absorbent material to remove an additional quantity of the non-magnetic material.

When the container 1001 is repositioned, the magnetic material 603 can remain attracted to the interior surface of the container 1001 while a quantity of the non-magnet material 601 can be poured out of the container 1001 through the opening 1005. A separate quantity of the non-magnetic material 601, which can include the desired material, can remain attached to the magnetic material 603 within the container 1001. As such, a quantity of the non-magnetic material 601 is poured out of the container while a second quantity of the non-magnetic material remains attached to the magnetic material 603 on the interior surface of the container 1001. The quantity of non-magnetic material 601 can be poured into the receiving device 801 as described above. Referring now to FIG. 13, the method can then optionally proceed to the step of depositing a quantity of the non-magnetic material 601 onto the absorbent material 901 as described above. As mentioned previously, a user can shake, tap, and/or move the magnetic separation device 101 such that the excess quantity of the non-magnetic material 601 can pour out of the opening 1005 and onto the absorbent material 901. At the same time, the container 1001 can retain the aligned orientation such that the magnetic material 603 can remain attracted to the interior surface of the container 1001 due to the fixed attachment of the container 1001 with the base 109.

As explained herein, the container 501, 1001 can be fixedly attached to a first support portion of the magnetic separation device 101. It is to be understood that the first support portion can include either of the base 109, the carriage 103 and/or another support portion of the device. For instance, when the container 501, 1001 is attached to the base 109, then the base 109 can be considered the first support portion. In the alternative, when the container 501, 1001 is attached to the carriage 103, then the carriage 103 can be considered the first support portion. Similarly, the first support portion could further include either of the main support portion 201 and/or the second support portion 203. For instance, when the container 501, 1001 is attached to the main support portion 201, then the main support portion 201 can be considered the first support portion. In the alternative, when the container 501, 1001 is attached to the second support portion 203, then the second support portion 203 can be considered the first support portion. As such, the first support portion is not limited to a specific structure, and could include any part of the magnetic separation device 101 to which the container 501, 1001 can be attached.

It will be apparent to those skilled in the art that various modifications and variations can be made without departing from the spirit and scope of the claimed invention.

What is claimed is:

1. A magnetic separation device comprising:

at least one magnetic element configured to produce a magnetic field; and a first support portion including a threaded opening configured to threadingly receive a threaded portion of a container to fixedly attach the container to the first support portion in an aligned orientation with respect to the at least one magnetic element, wherein the threaded opening is configured to retain the container in the aligned orientation when inverting the magnetic separation device.

2. The magnetic separation device of claim 1, wherein the threaded opening extends entirely through the first support portion, wherein the threaded opening is configured to fixedly suspend the container in the aligned orientation.

3. The magnetic separation device of claim 1, wherein the first support portion comprises a base and the at least one magnetic element is supported by the base.

4. The magnetic separation device of claim 1, further comprising a base and the at least one magnetic element is supported by the base.

5. The magnetic separation device of claim 4, further comprising a carriage including the first support portion, wherein the carriage is configured to be mounted with respect to the base such that the container is in the aligned orientation.

6. The magnetic device of claim 5, further comprising a second support portion including a threaded opening configured to threadingly receive a threaded portion of a container to fixedly attached the container to the second support portion, wherein the second support portion is configured to be releasably attached to the first support portion.

7. A magnetic separation device comprising:

at least one magnetic element configured to produce a magnetic field; and a first support portion including a first surface, a second surface, and a threaded opening configured to threadingly receive a threaded portion of a container to fixedly attach the container to the first support portion in an aligned orientation with respect to the magnetic element, wherein the threaded opening is configured to retain the container in the aligned orientation when inverting the magnetic separation device, and wherein the threaded opening extends past the first surface but does not extend past the second surface.

8. The magnetic separation device of claim 7, wherein the first support portion comprises a base and the at least one magnetic element is supported by the base.

9. The magnetic separation device of claim 7, further comprising a base and the at least one magnetic element is supported by the base.

10. The magnetic separation device of claim 9, further comprising a carriage including the first support portion, wherein the carriage is configured to be mounted with respect to the base such that the container is in the aligned orientation.

11. The magnetic device of claim 10, further comprising a second support portion including a threaded opening configured to threadingly receive a threaded portion of a container to fixedly attached the container to the second support portion, wherein the second support portion is configured to be releasably attached to the first support portion.

12. A magnetic separation device comprising:

at least one magnetic element configured to produce a magnetic field; and a first support portion including a first surface, a second surface, and a threaded opening configured to threadingly receive a threaded portion of a container to fixedly attach the container to the first support portion in an aligned orientation with respect to the at least one magnetic element, wherein the threaded opening is configured to retain the container in the aligned orientation when inverting the magnetic separation device, wherein the threaded opening is configured to initially threadingly receive the container via the first surface, and wherein the first surface is in closer proximity to the at least one magnetic element than the second surface.

13. The magnetic separation device of claim 12, wherein the threaded opening extends entirely through the first support portion, wherein the threaded opening is configured to fixedly suspend the container in the aligned orientation.

14. The magnetic separation device of claim 12, wherein the first support portion comprises a base and the at least one magnetic element is supported by the base.

15. The magnetic separation device of claim 12, further comprising a base and the at least one magnetic element is supported by the base.

16. The magnetic separation device of claim 15, further comprising a carriage including the first support portion, wherein the carriage is configured to be mounted with respect to the base such that the container is in the aligned orientation.

17. The magnetic device of claim 16, further comprising a second support portion including a threaded opening configured to threadingly receive a threaded portion of a container to fixedly attached the container to the second support portion, wherein the second support portion is configured to be releasably attached to the first support portion.

* * * * *